US007657949B2

(12) United States Patent
Zhadanov et al.

(10) Patent No.: US 7,657,949 B2
(45) Date of Patent: Feb. 9, 2010

(54) HOLLOW SHOWER PANEL

(76) Inventors: Sam Zhadanov, 2944 W. 5th St., Apt 20J, Brooklyn, NY (US) 11224; Eli Zhadanov, 2944 W. 5th St., Apt 20J, Brooklyn, NY (US) 11224

( * ) Notice: Subject to any disclaimer, the term of this patent is extended or adjusted under 35 U.S.C. 154(b) by 0 days.

(21) Appl. No.: 11/809,446

(22) Filed: Jun. 1, 2007

(65) Prior Publication Data

US 2008/0295241 A1 Dec. 4, 2008

(51) Int. Cl.
*A47K 3/22* (2006.01)

(52) U.S. Cl. ..... 4/615; 4/567; 4/601

(58) Field of Classification Search ..... 4/567, 4/568, 570, 601, 615
See application file for complete search history.

(56) References Cited

U.S. PATENT DOCUMENTS 3,333,284 A * 8/1967 Symmons ..... 4/670
5,678,258 A * 10/1997 Healy ..... 4/601
6,973,682 B2 * 12/2005 Zhadanov ..... 4/601
2005/0081288 A1 * 4/2005 Leung ..... 4/567

* cited by examiner

*Primary Examiner*—Robert M Fetsuga
(74) *Attorney, Agent, or Firm*—I. Zborovsky

(57) ABSTRACT

A device for showering and the like has a body having a front wall, a peripheral wall and an open rear side with an edge configured to abut against a wall, hose means associated with the body for supplying water for taking a shower, a through-going receptacle formed in the body, so that the body is formed as an element surrounding the receptacle, which receptacle allows a user through the receptacle to access existing water control means in assembled condition, means for connecting the hose means to a source of water, and to existing water controlled means, the body having at least a portion which is formed as a hollow element having a U-shaped cross-section with a rear edge configured to abut against a wall so as to form hollow channels for the hose means.

5 Claims, 8 Drawing Sheets

17
18
3
2
9
12
4
10
11
7
19
24
1
5
6

17
15a
14
13
8
18
16

3A
17
18
16
3
2A
2
9
20
4
1'
19
1'
21

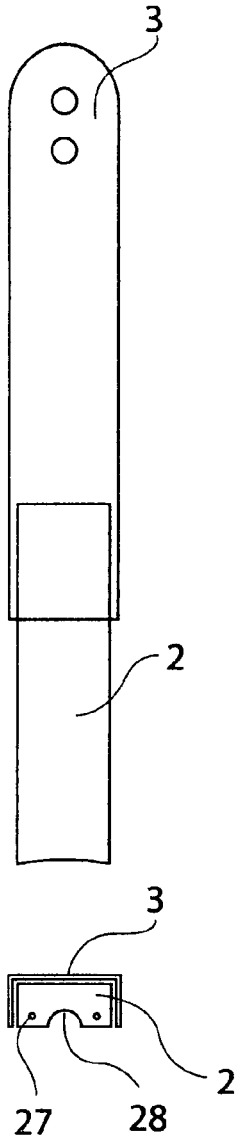
Fig. 11
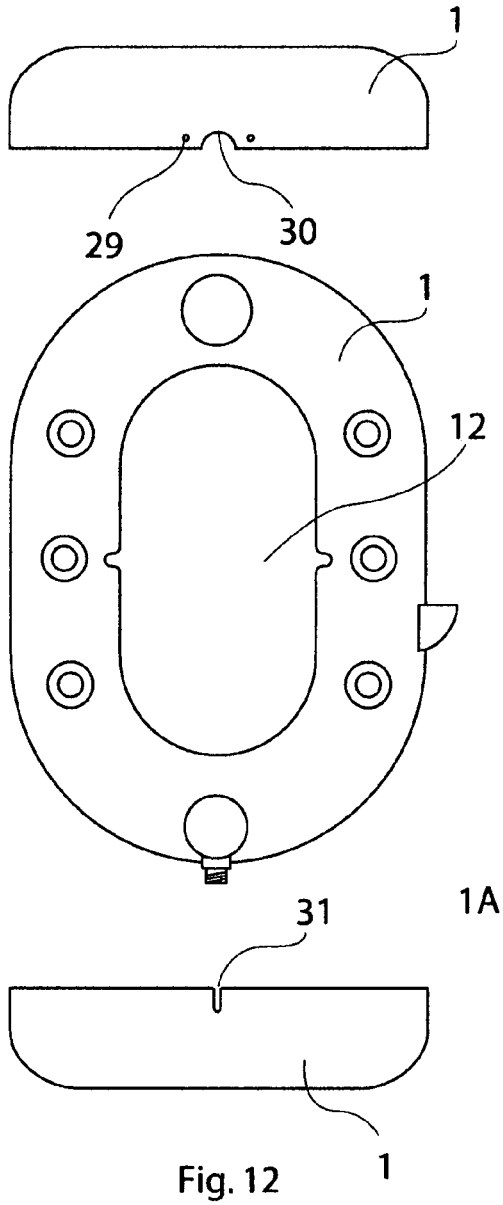
Fig. 12
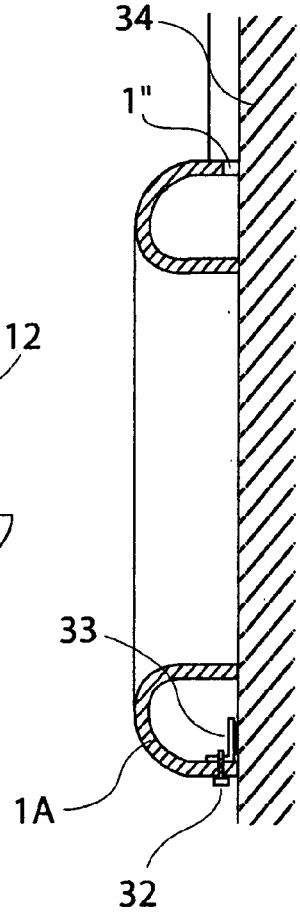
Fig. 13
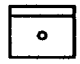

HOLLOW SHOWER PANEL

BACKGROUND OF THE INVENTION

The present invention relates to a device for taking showers and the like.

Devices of the above mentioned general type are known in the art. There are a plurality of devices which are mountable in bathrooms and used for issuing water for taking showers and the like. One of such devices is disclosed in our U.S. Pat. No. 6,973,682. It is believed that this device can be further improved.

SUMMARY OF THE INVENTION

Accordingly, it is an object of the present invention to provide a device for showering and the like, which is a further improvement of the existing devices.

In keeping with these objects and with others which will become apparent hereinafter, one feature of the present invention resides, briefly stated, in a device for showering and the like, comprising a body having a front wall, a peripheral wall and an open rear side with an edge configured to abut against a wall; hose means associated with said body for supplying water for taking a shower; a throughgoing receptacle formed in said body, so that said body is formed as an element surrounding said receptacle, which receptacle allows a user through said receptacle to access existing water control means in assembled condition; means for connecting said hose means to a source of water; and separate means for suspending said body, said means for connecting said hose means to a source of water including at least one hose extending from a rear side of said body to a front side of said body and connectable to the existing water control means, at least a part of said body being hollow and having a rear edge configured to be pressed against a wall so as to form hollow channels.

In accordance with another feature of the present invention a throughgoing passage is provided in the body and open at said rear side of the body to allow passage of a hose.

In accordance with still a further feature of the present invention, the body can be composed of upper and lower body parts movable relative to one another.

Shelves and the like can be mounted on the upper body part.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 11 is a front view of an upper body part of the inventive device for showing;

FIGS. 12 and 13 are a front view and a transverse cross-section of a lower body part arranged on a wall;

DESCRIPTION OF THE PREFERRED EMBODIMENTS

Figure 1:
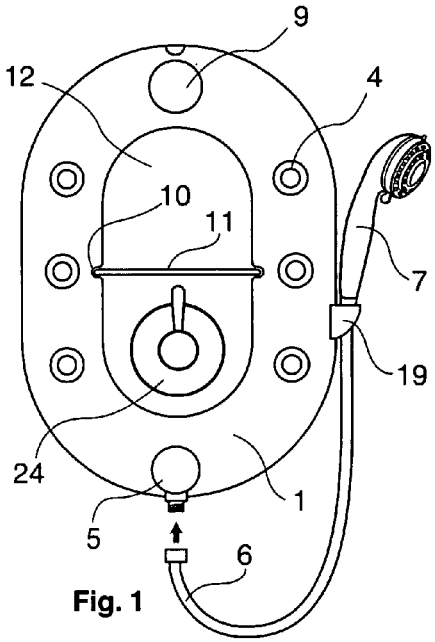
FIGS. 1, 2 and 3 are a front view, a rear view and a cross-section of a device for showering in accordance with one embodiment of the present invention.

A device shown in FIGS. 1-5 for showering and the like, in accordance with the present invention has a single body which is configured as a panel and identified as a whole with reference numeral 1. The body 1 is hollow and has a U-shaped cross-section with a front wall, a peripheral wall and an open rear side with an edge to abut against a wall and the like as shown in the drawing.

The U-shaped cross-section forms hollow channels for hoses and other elements. The edge of the rear side of the hollow body 1 is formed by rear ends of two legs that form U and are opposite to the web which connects the legs with one another. The rear ends of the two legs of U are substantially uninterrupted over a whole periphery of the body 1. The body 1 is mountable for example on a wall of a bathroom.

Figure 2:
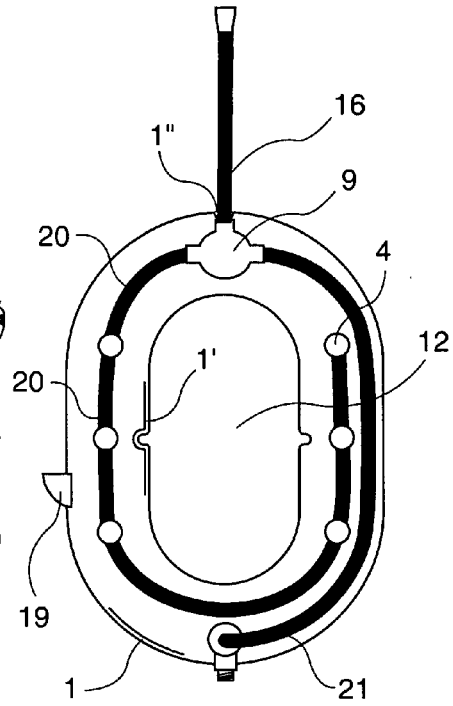
Figure 4:
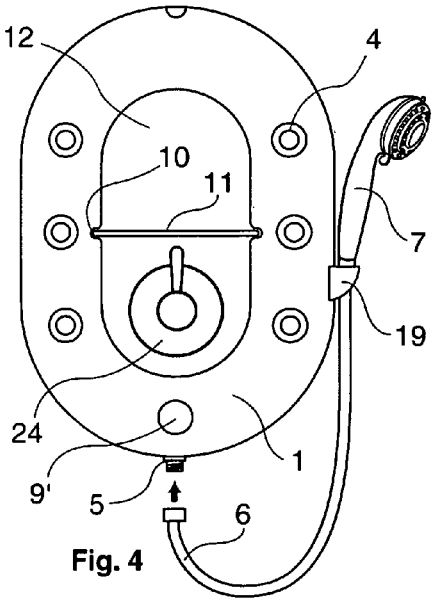
FIGS. 4 and 5 are a front view and rear view of a device for showering in accordance with another embodiment of the present invention.
Figure 5:
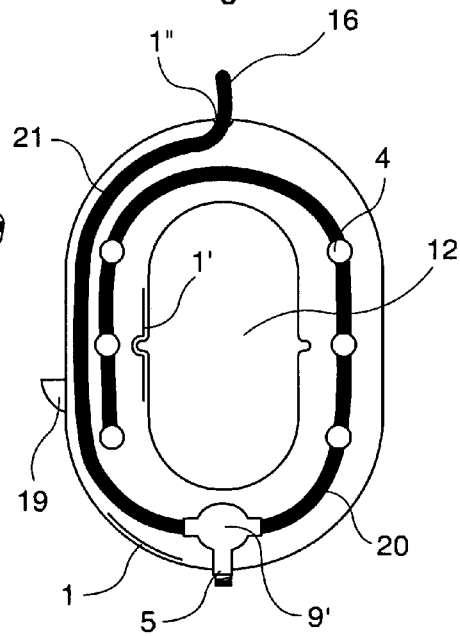

A pipe or hose system includes hose means with a hose 16 extending from a control 9 to a shower arm, a hose 20 extending from the control 9 to the nozzles 4, and a hose 21 extending to an outlet for a hand shower or a tub outlet as shown in FIGS. 1, 2. In the embodiment of FIGS. 4, 5 the control 9 and the outlet 5 form a single unit.

As can be seen from the drawings, two groups of the jet nozzle 4 are provided. The jet nozzles in each group are spaced from one another in a longitudinal direction, or in other words in the direction of elongation of the body 1, and also the groups of the jet nozzles are spaced from one another in a transverse direction. The control element 9 can be formed as a two-way zone control for switching water to corresponding elements, in particular to the nozzles 4, or to the outlet 5 for a hose 6 of a hand shower 7.

The device of FIGS. 1 and 2 is different from the device of FIGS. 4 and 5 in that the control 9' located at a lower side is connected by the hose 16 with a water source.

In accordance with the present invention a receptacle 12 is provided in the body 1 and formed as a throughgoing opening. The receptacle 12 is preferably elongated in the direction of elongation of the body 1. The body 1 is therefore formed as a peripherally closed hollow U-shaped element which surrounds the receptacle 12.

As shown in FIGS. 1-5 the receptacle 12 is formed so that an existing water control element 24 mounted on the wall of a bathroom and the like can be accommodated in the receptacle 12 so that the body 1 does not interfere with the water control element 24, and a user can correspondingly operate the control element 24, as needed, to supply water, to change water temperature, etc.

In the region of the receptacle, means are also provided for attaching at least one supporting member for supporting accessories. These means can be formed for example as a groove 10 in which a shelf 11 can be introduced forcedly to be retained in it. Accessories such as for example bottles with shampoo, conditioner, soap, etc. 12 can be placed on the shelf 11. The wall has a thickness. A reinforcement 1' can be provided in the region of the groove 10.

Shelves can be provided at both vertical sides of the control element 24 as considered in a vertical direction. When it is not necessary to arrange the control element 24 in the region of the receptacle, the shelve can occupy more space, and can be provided at various locations in the direction of elongation of the receptacle. As shown in the drawings, the direction of elongation of the receptacle 12 coincides with the direction of elongation of the body 1.

Figure 3:
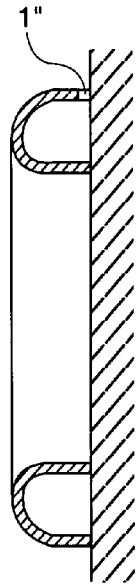

In accordance with the present invention, the hose 16 is connected with a source of water. For this purpose a passage 1" is provided in an upper edge (FIGS. 1-2) or in a lower edge (FIG. 10) of the receptacle 12 and formed for example as a slot which opens from a rear side of the body 1 as shown in FIG. 3. Therefore, the hose 16, can pass from the rear side of the body 1 to a lateral side of the body 1 or to a front side of the body through the slot.

Figures 6, 7, 8:
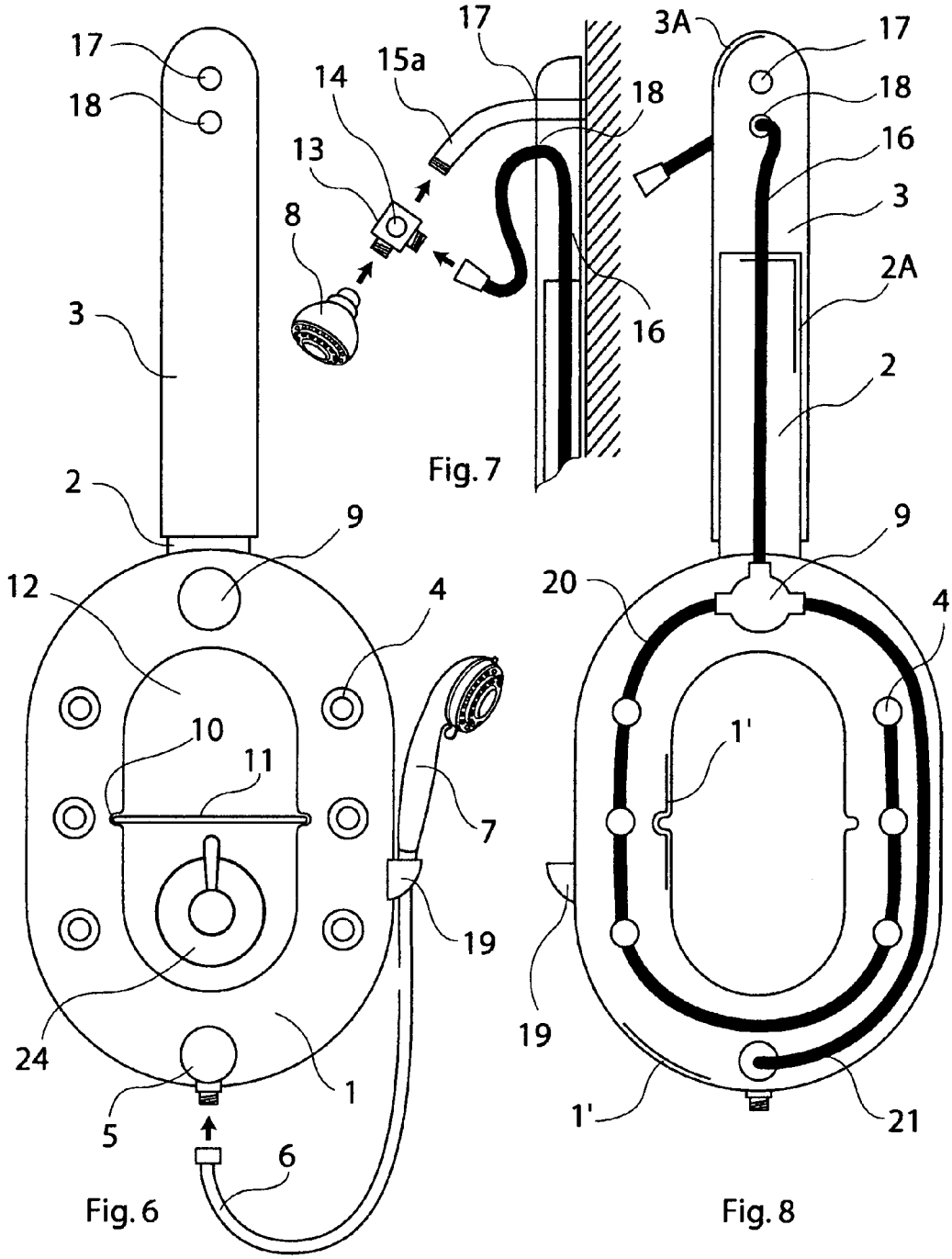
FIGS. 6-8 are views showing a front view, a partial side view, and a rear view of a device for showering and the like in accordance with a further embodiment of the present invention.

A device for showering shown in further FIGS. 6 and 8 has a lower body part 1, which corresponds to the body 1 of FIGS. 1-5, an upper body part 3, and a sliding element 2. In the shown embodiment the sliding element 2 can be fixedly connectable to the lower body part 1 and vertically slidable relative to the upper body part 3 (inside or outside of the latter). It is believed that an opposite arrangement is also possible.

The device further has a water supply hose 16 which is connectable to an existing water issuing element 15*a*, shown as an overhead shower arm, and to a water distribution control 9 which distributes incoming water through outlet hoses 20 and 21 to jet outlets 4 and to the outlet 5 connectable to a shower hose 6 with a hand shower 7.

The water supply hose 16 can be also connected to a 2-way water diverter 13, which then connects to the water issuing element 15*a* and to a shower head 8. Therefore, by turning a diverter switch 14, a user can divert a flow to the shower head or the panel.

The water supply hose 16 passes from the back of the body or panel through the sliding element 2 with the upper body 3 and comes out at a side or a front of the panel or the body through a passage 18. The upper body part 3 has an opening (passage 17) that allows to slide it over the water issuing element 15*a* in the form of an overhead shower arm, thereby securing its position vertically.

During installation the lower body part 1 can be positioned higher or lower (according to user's height preference in existing wall fixture limitations) by moving the lower body part 1 with a sliding element 2 into or out of the upper body part 3. The above described embodiment is shown in FIGS. 6-8.

Figure 9:
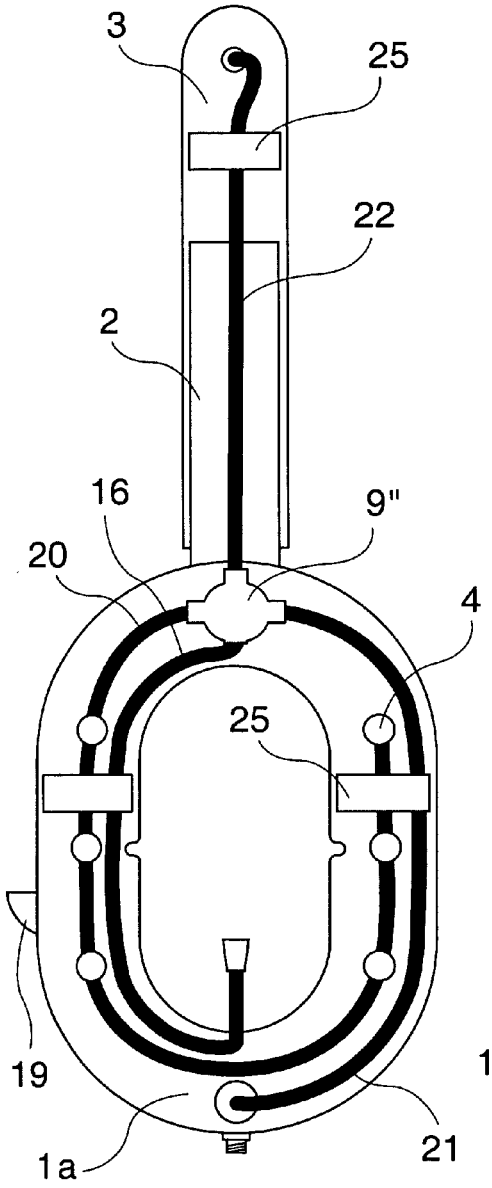
FIGS. 9 and 10 are a rear view and a front view of the device for showering and the like in accordance with a further embodiment of the combination.
Figure 10:
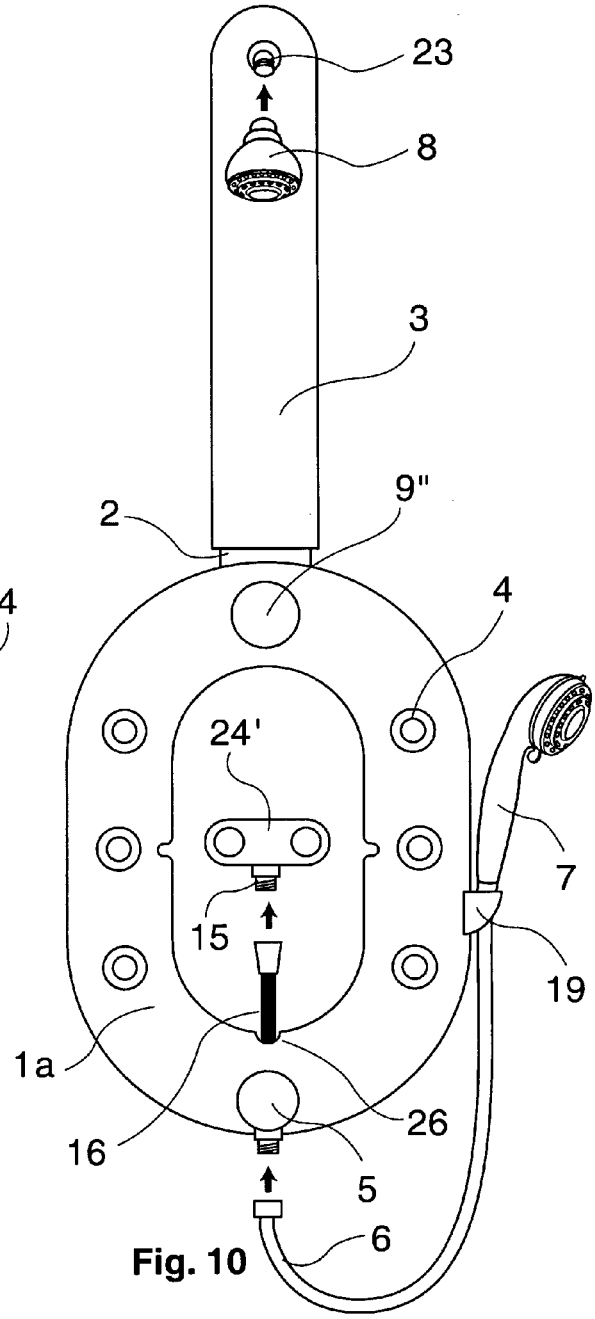

FIGS. 9-10 show another embodiment of the invention. It is used to fit showers when the water issuing element 15 is not an overhead shower arm, but instead a part of (or in the same area as) existing wall-mounted on/off/temperature control 24', usually located on a lower wall.

The water supply hose 16 comes to the front through a slot passage 26 and connects the water issuing element 15, which can end up inside of the receptacle 12, as shown, or outside, for example below the lower body part 1*a*.

In this case, the lower body part la can function without the elements 2 and 3 and without the shower head. However, if the shower head is desired, then the upper body part 3 and the sliding element 2 remain and an additional outlet hose 22 is connected to the water distribution control 9" passing through the sliding element 2 and the upper body 3 and connectable to a shower head outlet 23 built into the upper body part 3, to which the shower head 8 is connected. In this case, the water distribution control 9' must have an additional outlet connection and a switching means to direct water flow to three outlets, as in FIG. 9, instead of two outlets, as in FIG. 8.

When the overhead shower arm is not present, wall brackets 25 may be required to secure the upper and lower body parts of panel to the wall. This can be carried out by screws or adhesive tape.

As shown in FIGS. 11-13 the sliding element 2 can be connectable to the lower body 1 by screws inserted through screw holes 27 of the sliding element 2 and screw holes 29 of the lower body part 1 that are aligned with one another.

A hose passage slot 28 of the sliding element 2 is also aligned with a hose passage 30 of the lower body part 1 to allow passage of the water supply hose 16 or the shower outlet hose 22.

The lower body part 1 is lined up and connected to a wall by an L-shaped bracket 33 connectable to the lower body part 1 through a slot 31 by a tightening screw 32 and attachable to the wall by a piece of tape or screw. By loosening of the screw 32 the panel or the body of the device can be removed if needed, for example for cleaning, leaving the bracket 33 attached to the wall.

An important feature of the present invention resides in the shape of the body and its parts. As can be seen from FIG. 13, the lower body part 1 has a substantially hollow U-shaped cross-section with an open side top of U pressing against the wall, so as to create hollow tunnels for hiding connections, hoses, etc. and an opposite side (bottom of u) parallel to the wall. The upper body part 3 can have the same shape. The sliding element 2 can also have the same shape.

Figure 14:
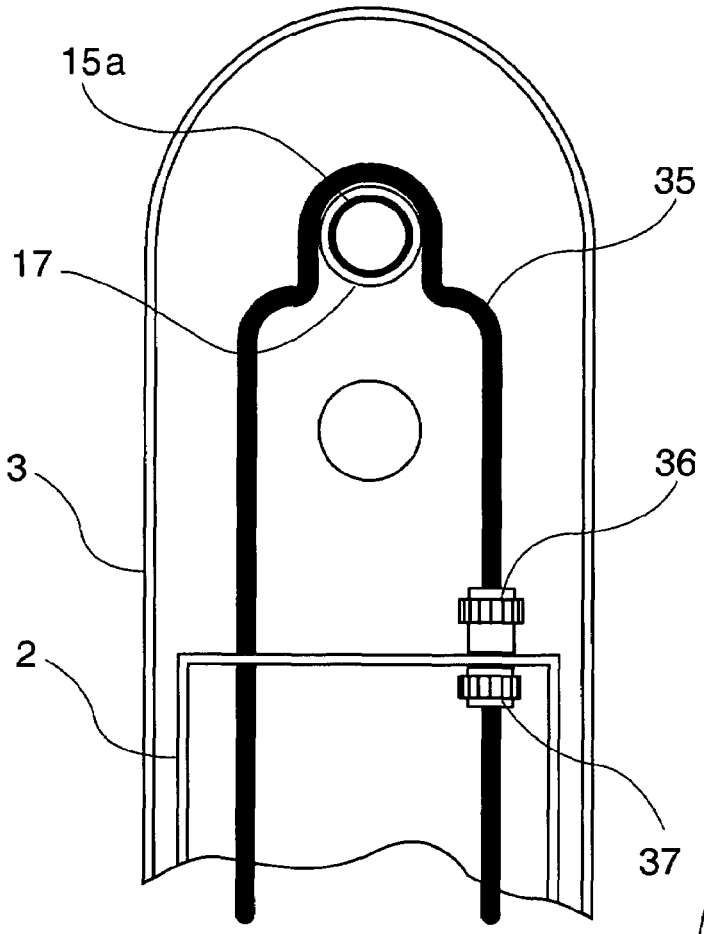
FIGS. 14 and 15 are views showing details of an upper body part and a sliding element of the device for showering and the like in accordance with the present invention.
Figure 16:
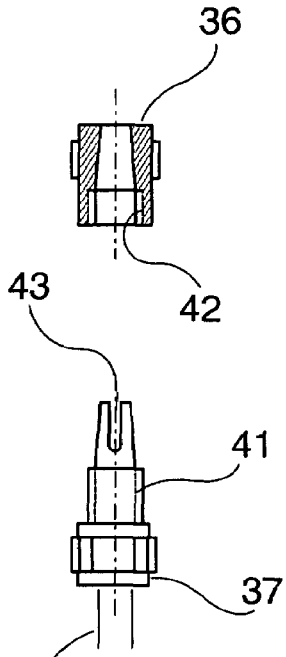
FIG. 16 is a view showing details which are used for connection of parts of the inventive device with one another.
Figure 15:
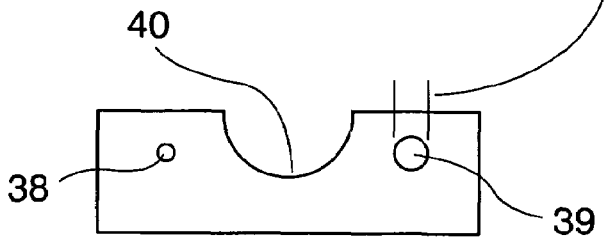
Figure 17:
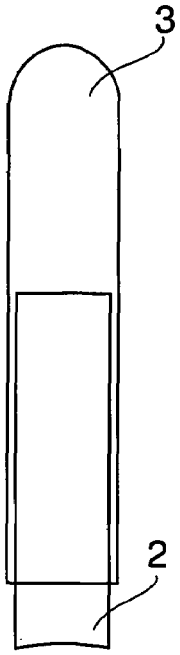
FIGS. 17-20 are views showing an upper body part with corresponding attachments of the inventive device.
Figure 18:
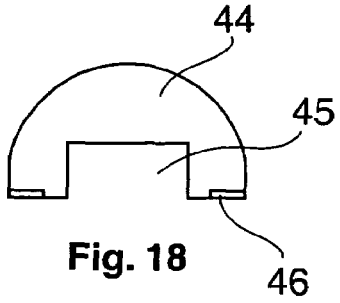
Figure 19:
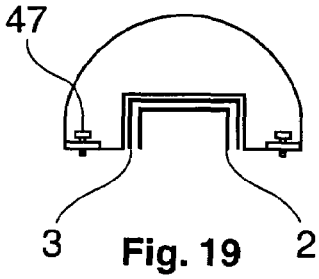
Figure 20:
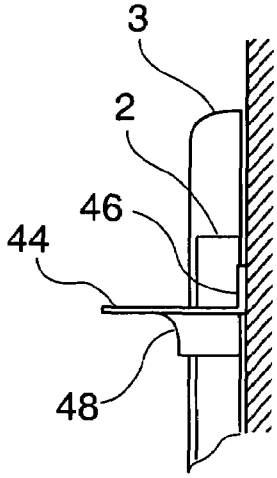

As can be seen from FIGS. 14-16, the sliding element 2 is connectable to the overhead shower arm or the water issuing element 15*a* by a wire rail 35. The rail 35 hands over the shower arm. Its ends are inserted into openings 38 and 39 of the sliding element 2 and through locking parts 36 and 37. The vertical position of the lower body part 1 is adjusted by moving the sliding element 2 up or down the rail.

To fix the position, a male thread 41 of the locking element 37 is inserted through an opening 39 and screws into a female thread 42 of the locking element 36. When this connection is tightened, the sliding element 3 is locked between the locking parts 36 and 37, while a slotted tip 43 of the locking element 2 grips around the rail 35, thus preventing a vertical movement.

As can be seen from FIGS. 17-20, a shelf or another part 44 can be provided, which has a cutout 45 fitting a profile and a depth of the upper body part 3. Therefore, when pressed against the upper body part, L-shaped mounting ends 46 of the shelf will also press against the wall to be mounted to it by an adhesive tape or screws 47. In addition, the shelf 44 can have a section 48 wrapping horizontally around the upper body part 3 to give the shelf an additional support.

Figure 21:
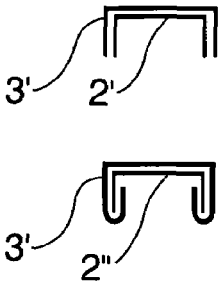
FIG. 21 is a view showing a configuration of a sliding element and the upper body part connectable with one another.
Figure 22:
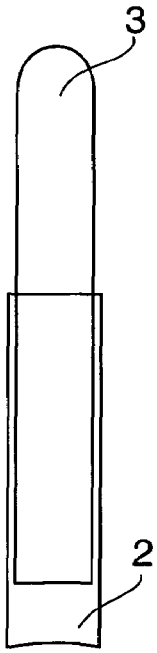
FIG. 22 showing an alternative construction of the sliding element with the upper body part of the inventive device.
Figure 23:
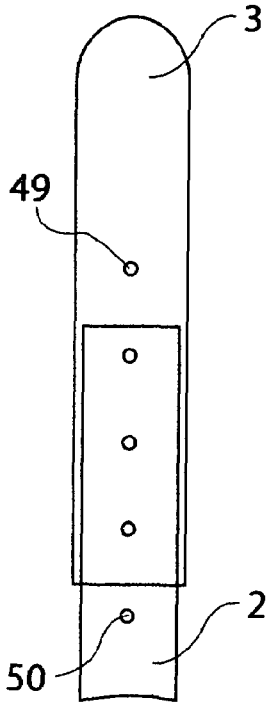
FIGS. 23-28 are views showing the upper body part with attachments and their connection with one another.
Figure 25:
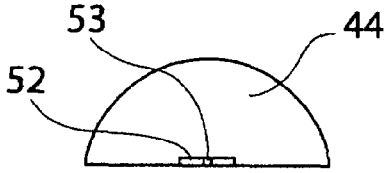
Figure 26:
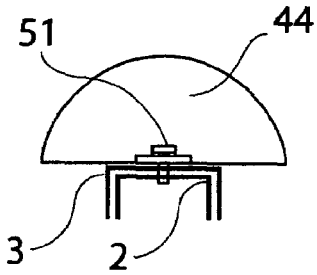
Figure 27:
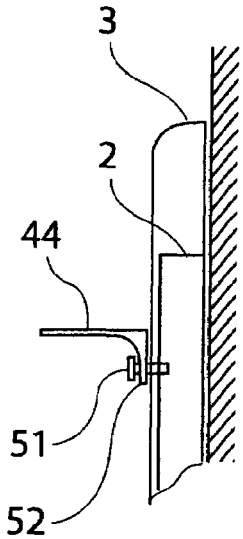
Figure 24:
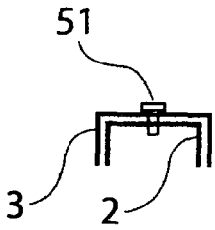
Figure 28:
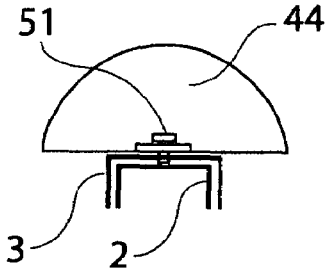
Figure 29:
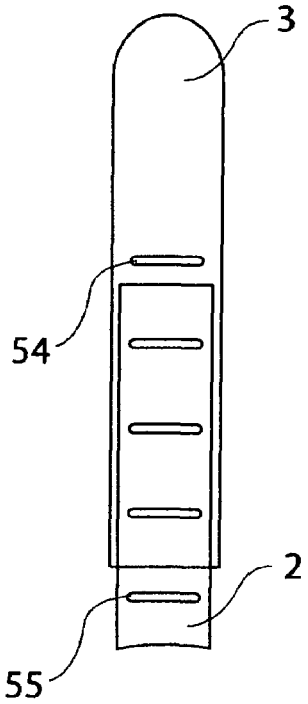
FIGS. 29-32 are views showing the upper body part with corresponding attachments in accordance with another embodiment of the present invention.
Figure 30:
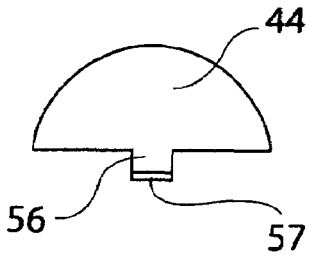
Figure 32:
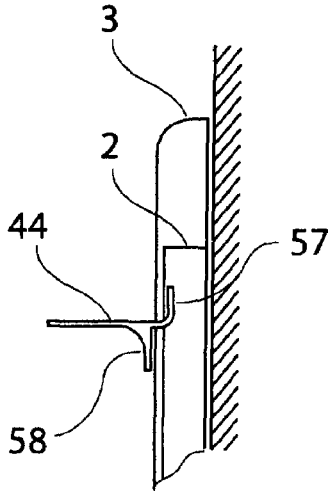
Figure 31:
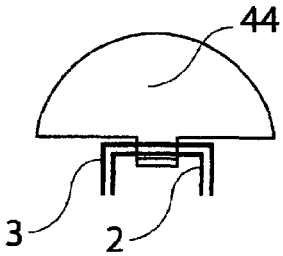

FIG. 21 shows an alternative construction of the sliding element and the upper body part 3', in which the sliding element 2' and the upper part 3' has an angled shape completely coextensive with one another, or also provided with additional rounded ends in the upper body part 3. In the embodiment shown in FIG. 16, the sliding element 2' is wider than the upper body part 3 and is slidable over the upper body part 3', instead of under it.

FIGS. 23-28 illustrate the connection of the upper body part 3 and the sliding element 2. The upper body part 3 and the sliding element 2 have one or more holes 49 and 50. When any of the two holes are aligned with one another, a locking pin 51 can be inserted to lock the upper body part 3 and the sliding element 2 with one another. When a plurality of holes 49 and 50 are used, the upper body part 3 and the sliding element 2 can be connected with one another at different points, making the assembly length-adjustable. In this case the shelf is mounted on the sliding element 2 instead of the upper body part 3.

In addition a fixture or a shelf 44 can be added. It has an L-shaped mounting on a support section 52 with a pin hole 53. A locking pin 51 can be inserted through the pin hole 53, 49 and 50 to hold the shelf 44 in place and at the same time to lock the sliding element 2 to the upper body part 3.

In the embodiment shown in FIGS. 29-32 the sliding element 2 and the upper body part 3 are provided with a plurality of slots 54 and 55, instead of the holes of the previous embodiment. When any of two corresponding slots are aligned with one another, sections 56 and 57 of the shelf 44 are inserted through both slots to lock the sliding element and the upper body part 3 together, and at the same time to provide the storage space for the user. The shelf 44 is held in place by the locking section 57 and a support section 58.

It will be understood that each of the elements described above, or two or more together, may also find a useful application in other types of constructions differing from the types described above.

While the invention has been illustrated and described as embodied in a shower panel, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

The invention claimed is:

1. A device for showering and the like, comprising a body configured a panel and having a front wall, a peripheral wall and an open rear side with a rear edge configured to abut against a wall; hose means associated with said body for supplying water for taking a shower, said hose means being connectable to a source of water and to existing water control means; said body having at least a portion which is formed as a hollow element having a U-shaped cross-section with the rear edge configured to abut against a wall so as to form hollow channels for said hose means, wherein said body part has an upper body part and a lower body part which are vertically movable relative to one another in a vertical direction; and further comprising at least one attaching element having a cutout corresponding to a cross-section of said upper body part.

2. A device for showering and the like, comprising a body configured as a panel and having a front wall, a peripheral wall and an open rear side with a rear edge configured to abut against a wall; hose me ans associated with said body for supplying water for taking a shower, said hose means being connectable to a source of water and to existing water control means; a throughgoing receptacle formed in said body, so that said body is formed as an element surrounding said receptacle, which receptacle allows a user through said receptacle to access existing water control means in assembled condition; said body having at least a portion which is formed as a hollow element having a U-shaped cross-section with the rear edge configured to abut against a wall so as to form hollow channels for said hose means, wherein said body part has an upper body part and a lower body part which are vertically movable relative to one another in a vertical direction; and further comprising at least one attaching element having a cutout corresponding to a cross-section of said upper body part.

3. A device as defined in claim 2, wherein said rear edge of said hollow U-shaped body is formed by ends of two legs of U which are opposite to a web that connects said legs with one another.

4. A device as defined in claim 2, wherein said body has at least one throughgoing passage which opens at said rear edge of said body so as to allow a hose of said hose means to pass from a rear side of said body when said rear edge of said body is placed against the wall.

5. A device for showering and the like, comprising a body configured as a panel and having a front wall, a peripheral wall and an open rear side with a rear edge configured to abut against a wall; hose means associated with said body for supplying water for taking a shower, said hose means being connectable to a source of water and to existing water control means; a throughgoing receptacle formed in said body, so that said body is formed as an element surrounding said receptacle, which receptacle allows a user through said receptacle to access existing water control means in assembled condition; said body having at least a portion which is formed as a hollow element having a U-shaped cross-section with the rear edge configured to abut against a wall so as to form hollow channels for said hose means, wherein said body has an upper body part and a lower body part which is vertically movable relative to one another in a vertical direction; and further comprising a sliding element connected to said lower part of said body, and means for connecting said sliding element to an overhead shower arm, wherein said means for connecting said sliding element to an overhead shower arm include a wire rail connectable with said sliding element and configured to hang over a shower arm.

* * * * *